US009970697B2

(12) United States Patent
Pawar

(10) Patent No.: US 9,970,697 B2
(45) Date of Patent: May 15, 2018

(54) MULTI-PART ICEMAKER BAIL ARMS AND ICEMAKERS

(71) Applicant: Whirlpool Corporation, Benton Harbor, MI (US)

(72) Inventor: Vijay Shahaji Pawar, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 439 days.

(21) Appl. No.: 14/484,317

(22) Filed: Sep. 12, 2014

(65) Prior Publication Data

US 2016/0076803 A1 Mar. 17, 2016

(51) Int. Cl.
*F25C 5/187* (2018.01)
*F25C 5/18* (2018.01)

(52) U.S. Cl.
CPC ..... *F25C 5/187* (2013.01)

(58) Field of Classification Search
CPC ..... F25C 5/187; F25C 5/182; F25C 2700/02
USPC ..... 62/137; 248/183.3, 292.13, 590, 597, 248/289.31; 222/41; 53/503; 200/61.2, 200/61.21; 73/149
See application file for complete search history.

(56) References Cited

U.S. PATENT DOCUMENTS 3,545,217 A 12/1970 Linstromberg
3,621,668 A * 11/1971 Swerbinsky ..... F25C 5/005 200/61.21
3,926,007 A 12/1975 Braden et al.
5,119,639 A 6/1992 Bein et al.
5,160,094 A 11/1992 Willis et al.
5,182,925 A 2/1993 Alvarez et al.
5,207,761 A 5/1993 Ruff
5,291,752 A 3/1994 Alverez et al.
5,329,786 A 7/1994 Willis et al.
5,460,007 A 10/1995 Reed et al.
5,479,707 A 1/1996 Alverez et al.
5,596,182 A 1/1997 Edwards et al.
5,619,858 A 4/1997 Gunderson et al.
5,718,121 A 2/1998 Edwards et al.
5,722,244 A 3/1998 Shelton
5,755,104 A 5/1998 Rafalovich et al.
5,768,899 A 6/1998 Lee et al.
5,768,900 A 6/1998 Lee
5,889,243 A 3/1999 Edwards et al.
6,050,097 A 4/2000 Nelson et al.
6,334,319 B1 1/2002 Senner
6,745,578 B2 6/2004 Collins et al.
7,134,292 B2 11/2006 Oh
(Continued)

FOREIGN PATENT DOCUMENTS

WO WO 2013169058 A1 * 11/2013 ..... F25C 5/16

*Primary Examiner* — Frantz Jules
*Assistant Examiner* — Schyler S Sanks

(57) ABSTRACT

Example multi-part icemaker bail arms are disclosed. An example multi-art icemaker bail arm includes a first member having a first end rotationally attached to the icemaker, and a second member attached to an opposite end of the first member, the second member moveable relative to the first member in response to a lateral force applied to the second member. An example icemaker includes a bail arm, a power source monitor to provide a signal representative of a power source state, a direct-current motor to retract the bail arm when the signal represents a power source interruption, and a battery to power the motor.

8 Claims, 6 Drawing Sheets

(56) References Cited

U.S. PATENT DOCUMENTS

| | | | | |
|---|---|---|---|---|
| 7,266,962 | B2 | 9/2007 | Montuoro et al. | |
| 7,579,564 | B2 * | 8/2009 | Henderson | G01L 5/26 200/61.2 |
| 7,770,404 | B2 | 8/2010 | An et al. | |
| 7,878,595 | B2 * | 2/2011 | Imajou | B60N 2/3011 297/367 R |
| 8,033,134 | B2 | 10/2011 | Litch et al. | |
| 8,528,350 | B2 | 9/2013 | Lee et al. | |
| 2007/0186571 | A1 * | 8/2007 | Kopf | F25C 5/187 62/135 |
| 2007/0220909 | A1 * | 9/2007 | An | F25C 1/04 62/137 |
| 2009/0031736 | A1 | 2/2009 | Su et al. | |
| 2010/0005818 | A1 | 1/2010 | Saito et al. | |
| 2015/0082816 | A1 * | 3/2015 | Park | F25C 5/16 62/66 |

* cited by examiner

MULTI-PART ICEMAKER BAIL ARMS AND ICEMAKERS

FIELD OF THE DISCLOSURE

This disclosure relates generally to icemakers, and, more particularly, to multi-part icemaker bail arms.

BACKGROUND

Many refrigerators and freezers include icemakers. Some icemakers include a bail arm that is used to sense the amount of ice in an ice storage bin.

SUMMARY

Example multi-part icemaker bail arms are disclosed. An example multi-art icemaker bail arm includes a first member having a first end rotationally attached to the icemaker, and a second member attached to an opposite end of the first member, the second member rotationally moveable relative to the first member in response to a lateral force applied to the second member. In some examples, the second member is rotationally moveable relative to the first member in two directions.

An example icemaker includes a bail arm, a power source monitor to provide a signal representative of a power source state, a direct-current motor to retract the bail arm when the signal represents a power source interruption, and a battery to power the motor. In some examples, the bail arm of the icemaker includes a first member having a first end rotationally attached to the icemaker, and a second member attached to an opposite end of the first member, the second member rotationally moveable relative to the first member in response to a lateral force applied to the second member.

DETAILED DESCRIPTION

Figure 1:
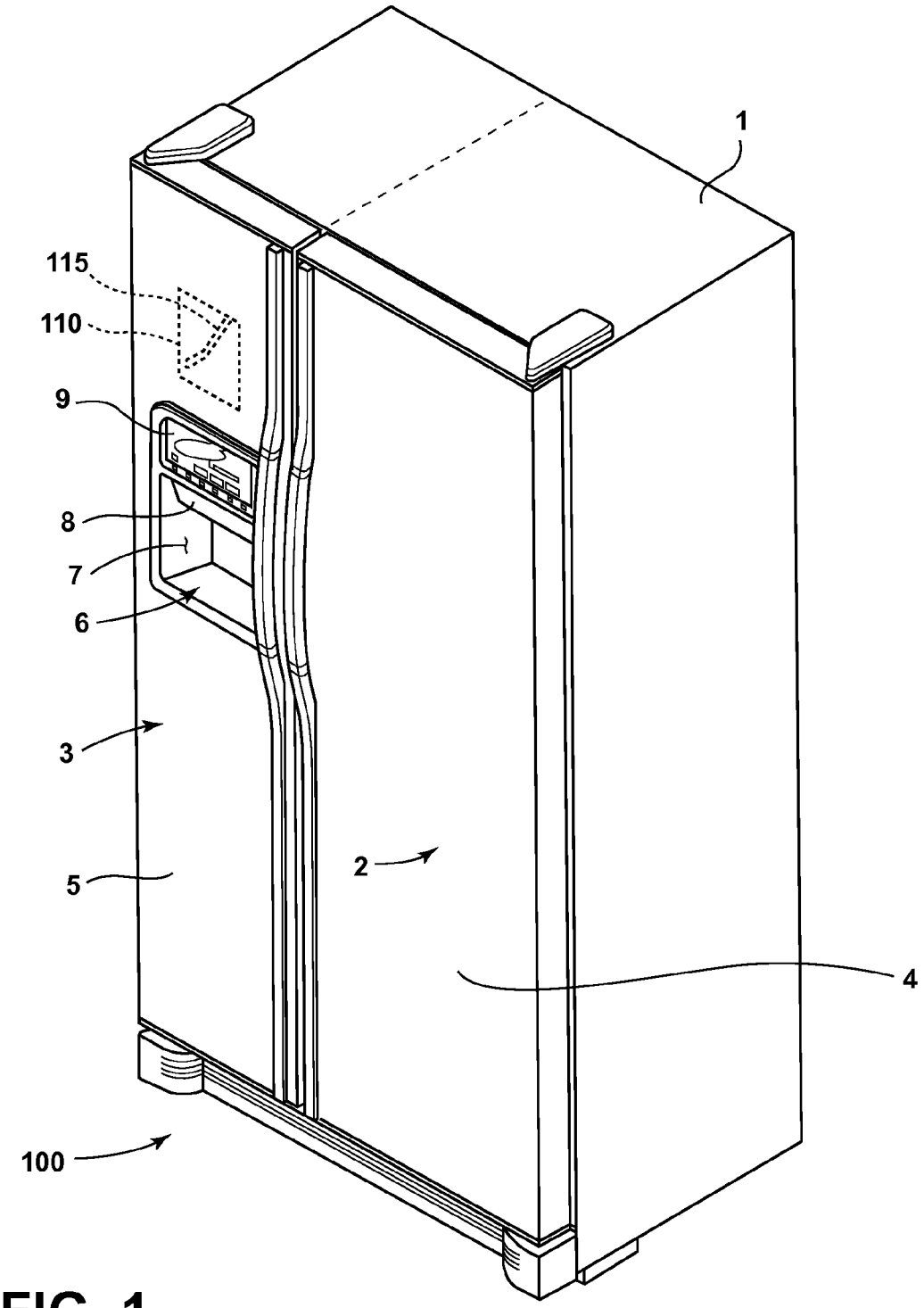
FIGS. 1 and 2 are perspective views of an example refrigerator including an icemaker having a multi-part bail arm constructed in accordance with the teachings of this disclosure.

The bail arm of conventional icemakers is a slender, elongated, single piece of plastic that is rotationally moved up and down in an ice storage bin to sense the amount of ice in the bin. Typically, a first end of the bail arm is rotationally fixed in place, while an opposite end rotates about the first end. The amount of ice in the bin may be used to control when and in what amount ice should be made. Even though the bail arm is nominally kept in an upward or retracted position, a user may inadvertently access the ice bin while the bail arm is in a downward position. In such cases, the bin may come in contact with the bail arm potentially causing inadvertent damage to or breakage of the bail arm. Moreover, the bail arm may become jammed between the ice bin and icemaker housing. Further, such contact may prevent or make more difficult the removable of the ice bin. Such circumstances may be perceived negatively by users, and/or may result in user inconvenience to have a repair performed. These circumstances may be present over a longer period of time during, for example, a power outage.

To overcome at least these problems, example multi-part icemaker bail arms are disclosed that have a part of the bail arm that is able to move relative to another part of the bail arm. Such movement occurs as the bail arm comes in contact with an ice bin. Because the bail arm is thus able to realize a break in the form or shape of the bail arm, the bail arm is able to substantially move out of the way of a moving ice bin. In some examples, the bail arm is able to reduce contact with an ice bin as the ice bin moves both in and out of an icemaker. In disclosed examples, an icemaker bail arm includes two or more members assembled together using one or more torsion springs and a hinge pin. A stopper may be included to define a range or amount of rotation that avoids or reduces the likelihood of contact between the bail arm, the ice bin, and a housing of the icemaker.

Any terms such as, but not limited to, approximately, substantially, generally, etc. are used herein to indicate that a precise value, structure, feature, etc. is not required, need not be specified, etc. Such terms will have ready and instant meaning to one of ordinary skill in the art. Moreover, it will be understood that practical implementations in accordance with this disclosure may have tolerances in their dimensions, etc. However, such tolerances do not impact the applicability of the claims of this patent. For example, a member described or claimed as being disposed at an angle relative to another member is understood to be disposed at generally, approximately, substantially, etc. that angle. Furthermore, references to directions such as horizontal and vertical used in the examples described herein or the appended claims are understood to be with regards to a particular orientation. It is also to be understood that such references are to be adjusted were a claimed invention viewed from a different orientation. Thus, an element that is merely rotated relative to a claimed invention is to be considered an equivalent under the scope of coverage of this patent.

In this specification and the appended claims, the singular forms "a," "an" and "the" do not exclude the plural reference unless the context clearly dictates otherwise. Further, any conjunctions such as "and," "or," and "and/or" used in this specification and the appended claims are inclusive unless the context clearly dictates otherwise. For example, "A and/or B" includes A alone, B alone, and A with B; "A or B" includes A with B, and "A and B" includes A alone, and B alone. Further still, connecting lines, or connectors shown in the various figures presented are intended to represent example functional relationships and/or physical or logical couplings between the various elements. It should be noted that many alternative or additional functional relationships, physical connections or logical connections may be present in a practical device. Moreover, no item or component is essential to the practice of the embodiments disclosed herein unless the element is specifically described as "essential" or "critical".

Reference will now be made in detail to embodiments of this disclosure, examples of which are illustrated in the accompanying drawings. The embodiments are described below by referring to the drawings, wherein like reference numerals refer to like elements. Here, configurations of an example refrigerator according to this disclosure will be described with reference to FIGS. 1 and 2. While the examples disclosed herein are described and illustrated with reference to the freezer compartment of a side-by-side refrigerator, those of ordinary skill in the art will recognize that the examples disclosed herein may be implemented in the freezing compartment of any appliance, apparatus, device, or machine having an icemaker with a bail arm including, but not limited to, a French-door bottom-freezer refrigerator, a refrigerator with a top-mount freezer, a freezer, a standalone icemaker, etc.

FIG. 1 is a perspective view of an example refrigerator 100 including an on-the-door icemaker 110 having a multi-part bail arm 115 according to this disclosure. The example refrigerator 100 includes a main cabinet 1 partitioned into a refrigerating compartment 2 and a freezing compartment 3 having respective front openings. A refrigerating compartment door 4 and a freezing compartment door 5 respectively open and close the respective front openings of the refrigerating and freezing compartments 2, 3.

In the front of the example freezing compartment door 5 is formed a dispenser 6 having a dispensing part 7 that is typically recessed to accommodate a container to receive, for example, water and ice for consumption by a person or animal. The dispensing part 7 includes a discharging lever 8 for operating the dispenser 6. The discharging lever 8 is, for example, press-able, or rotatable forward and backward inside the dispensing part 7. Alternatively, a user interface 9 may be used to operate the dispenser 6. The user interface 9 may, additionally or alternatively, be used to implement any number and/or type(s) of additional or alternative functions. An example user interface 9 includes a capacitive touch area, although other types of user interface elements may of course be used. While in the example of FIG. 1, the dispenser 6 is formed in the freezing compartment door 5, the dispenser 6 may be located elsewhere. For example, in the refrigerator compartment door 4, inside the refrigerator compartment 2, inside the freezing compartment 3, etc. A refrigerator implementing the icemaker bail arms disclosed herein need not have a dispenser or user interface.

Figure 2:
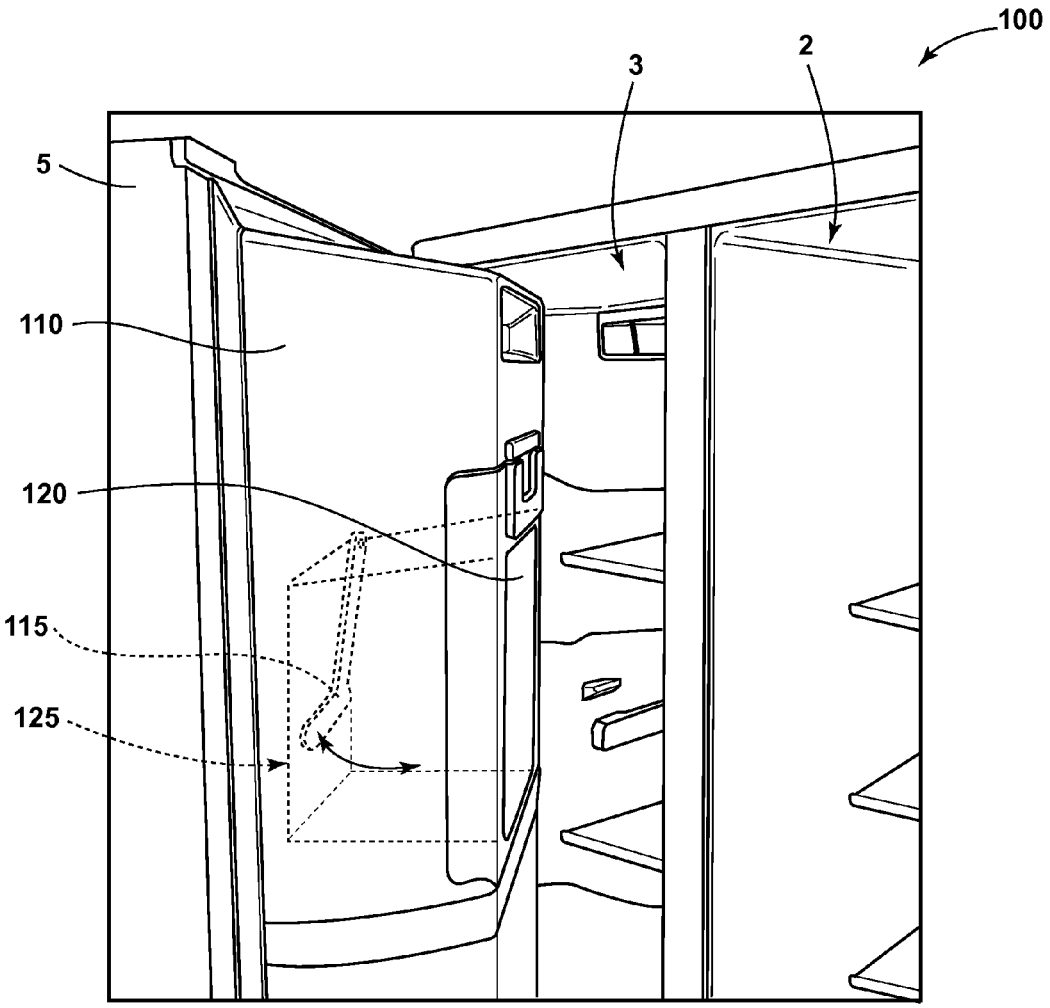
Figure 3A:
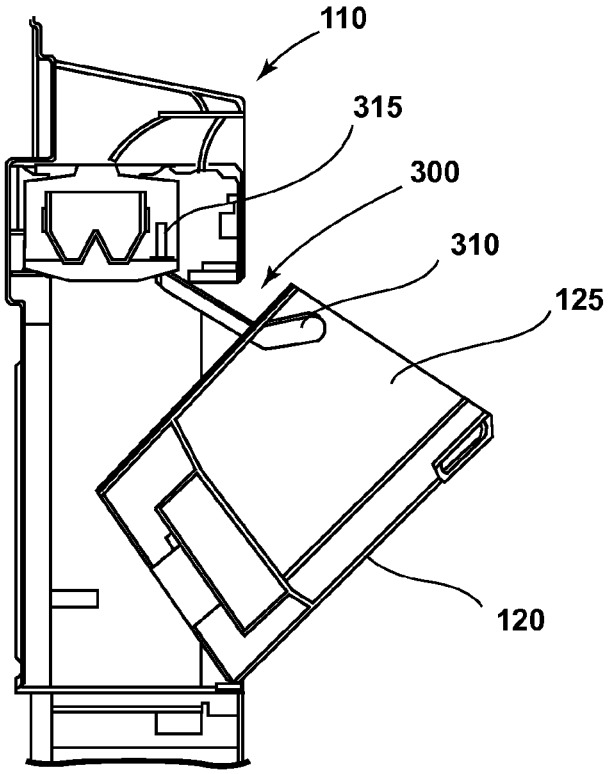
FIGS. 3A and 3B illustrate an example manner of implementing the multi-part icemaker bail arm of FIGS. 1 and 2.

Turning to FIG. 2, to make, store and dispense ice, the example refrigerator 100 includes the on-the-door icemaker 110 on the inside of the door 5. The example icemaker 110 of FIGS. 1 and 2 includes a multi-part bail arm 115 constructed according to this disclosure, which reduces the potential likelihood of inadvertent bail arm breakage, damage and/or jamming. Example manners of implementing the example bail arm 115 of FIGS. 1 and 2 are described below in connection with FIGS. 3A-B, 4A-B, and 5A-D. The icemaker 110 may be fixedly or removeably mounted to the door 5. The on-the-door icemaker 110 dispenses ice through the door 5, as shown in FIG. 1 and as is well understood. The example icemaker 110 of FIGS. 1 and 2 includes a door, cover, front, etc. 120 to enable ice to be removed from an ice storage area, container, bucket, bin, etc. 125 (e.g., see FIGS. 3A, 4A and 5A). As shown in FIGS. 3A, 4A and 5A, the front 120 may be an integral part of the bin 125. Access to ice present in the bin 125 may be obtained, for example, by rotating and/or removing the bin 125 from the icemaker 110.

The example multi-part bail arm 115 of FIGS. 1 and 2 rotates up and down within the bin 125. As is conventional, the bail arm 115 has a lower end that rotates up and down about upper end. The upper end is rotationally affixed to the icemaker 110 so the lower end can rotate up and down about the upper end. The bail arm 115 is moved downward to sense the amount of ice in the bin 125, and then moved back to an up or retracted position. Use and control of the bail arm 115 to sense the amount of ice, and control ice making is well known and will not be described herein. In comparison to the prior art, the example multi-part bail arm 115 of FIGS. 1 and 2 is constructed to reduce the potential likelihood of inadvertent breakage, damage and/or jamming. Example manners of implementing the multi-part bail arm 115 are described below in connection with FIGS. 3A-B, 4A-B, and 5A-D.

Figure 3B:
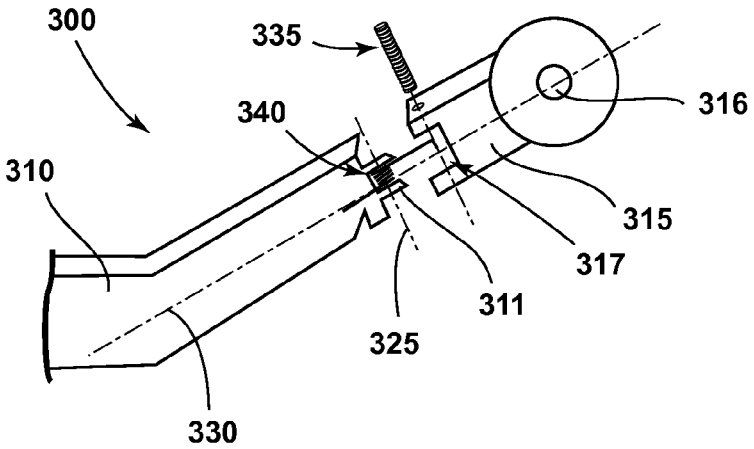
Figure 4A:
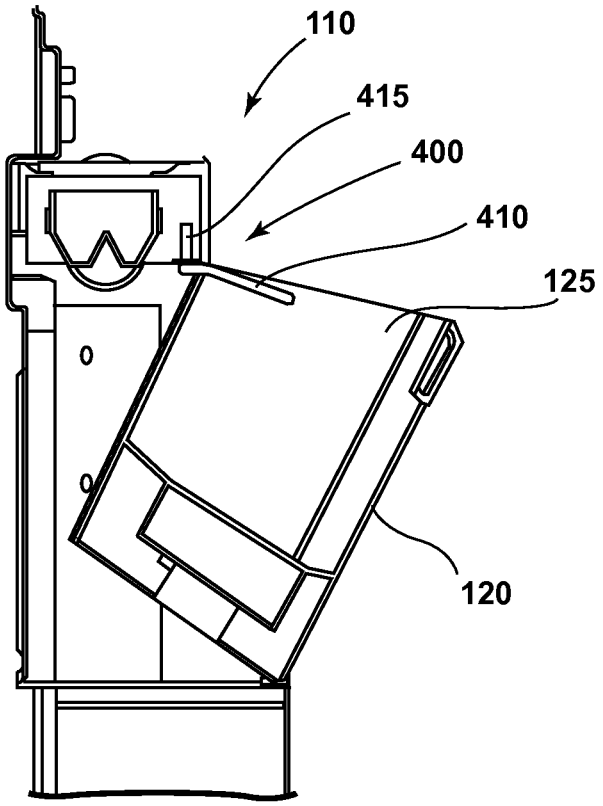
FIGS. 4A and 4B illustrate another example manner of implementing the multi-part icemaker bail arm of FIGS. 1 and 2.

FIGS. 3A and 3B illustrate an example two-part icemaker bail arm 300 that may be used to implement the example bail arm 115 of FIGS. 1 and 2. FIG. 3A is a cross-sectional view of the icemaker 110 with the example bail arm 300. FIG. 3B is a cross-sectional view of a part of the example two-part bail arm 300.

As shown in FIG. 3A, if the ice bin 125 is rotated forward while the bail arm 300 is in at least a partial downward position, the ice bin 125 and the bail arm 300 may come into contact. Such contact results in a lateral force being applied to the bail arm 300. In response to the lateral force, the two-part bail arm 300 bends or breaks so a lower member 310 rotates forward relative to an upper member 315.

As shown in FIG. 3B, the upper member 315 has a hole 316 that allows the bail arm 300 to rotate up and down within the ice bin 125. The lower and upper members 310, 315 meet at an angle 325 perpendicular to the longitudinal axis 330 of the lower member 310.

The lower member 310 is hingedly attached to the upper member 315 via a hinge pin, fastener, screw, bolt, etc. 335 that passes at least partially through both of the members 310, 315. Of course, other arrangements may be used. The pin 335 is rotatable with regards to one or both of the members 310, 315. The example lower member 310 has a protrusion 311 that fits into a slot 317 in the upper member 315. Of course, other configurations may be used.

In response to a lateral force, the lower member 310 rotates relative to the upper member 315 bringing the lower member 310 from a downward position toward a horizontal position. That is the lower member 310 rotates about a longitudinal axis of the pin 335.

To bias the lower member 310 into longitudinal alignment with the upper member 315 when, for example, no or a smaller lateral force is acting on the lower member 310, the example bail arm 300 includes a torsion spring 340. The pin 335 passes through and is coaxial with the torsion spring 340.

Figure 4B:
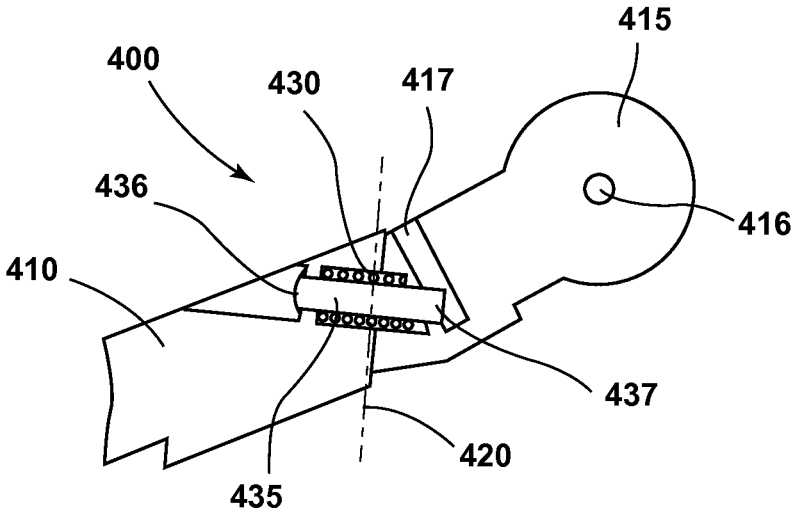
Figure 5A:
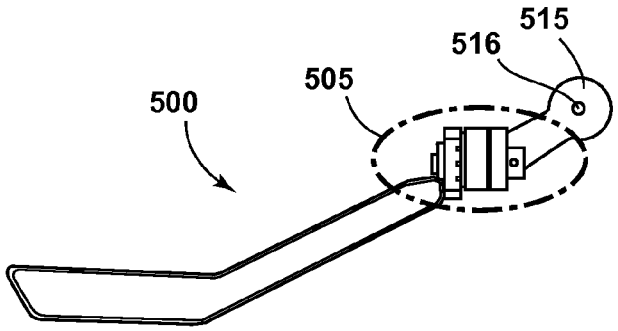
FIGS. 5A-D illustrate yet another example manner of implementing the multi-part icemaker bail arm of FIGS. 1 and 2.

FIGS. 4A and 4B illustrate another example two-part icemaker bail arm 400 that may be used to implement the example bail arm 115 of FIGS. 1 and 2. FIG. 4A is a cross-sectional view of the icemaker 110 with the example bail arm 400. FIG. 4B is a cross-sectional view of a part of the example bail arm 400.

As shown in FIG. 4A, if the ice bin 125 is rotated forward while the bail arm 400 is in at least a partial downward position, the ice bin 125 and the bail arm 400 may come into contact. Such contact results in a lateral force being applied to the bail arm 400. In response to the lateral force, a lower member 410 of the example two-part bail arm 400 moves forward relative to an upper member 415. In comparison with FIGS. 3A and 3B, the example bail 400 of FIGS. 4A and 4B is able to move into a more horizontal position because the lower member 410 is horizontally hinged to the upper member 415. This allows the hockey-stick shaped or angled distal end of the lower member 410 (best shown in FIG. 3A as the distal end of the lower member 310) to rotate to the horizontal or into a flat profile, as shown in FIG. 4A. This provides additional clearance between the bail arm 400 and the ice bin 125.

As shown in FIG. 4B, the upper member 415 has a hole 416 that allows the bail arm 400 to rotate up and down within the ice bin 125. In the orientation of FIGS. 4A and 4B, the upper and lower members 410, 415 meet at a vertical angle 420.

To bias the lower member 410 into longitudinal alignment with the upper member 415 when, for example, no or a smaller lateral force is acting on the lower member 410, the example two-part bail arm 400 includes a torsion spring 430 arranged perpendicular to the angle 420, that is, horizontally in the orientation of FIGS. 4A and 4B.

To hold the members 410, 415 together, the bail arm 400 includes a hinge pin, fastener, screw, bolt, etc. 435 that passes at least partially through the members 410, 415. Of course, other arrangements may be used. The example pin 435 passes through and is coaxial with the torsion spring 430. In the example of FIG. 4B, the pin 435 has a head 436 that engages the lower member 410, and a snap fitting 437 that engages an opening 417 in the upper member 415. The pin 435 is rotatable with regards to one or both of the lower and upper members 410, 415.

In response to a lateral force, the lower member 410 rotates relative to the upper member 415 bringing the lower member 410 from a downward position toward a horizontal flat position. That is the lower member 410 rotates about a longitudinal axis of the pin 435.

Figure 5B:
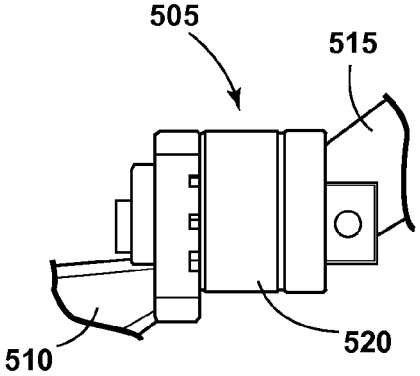
Figure 5C:
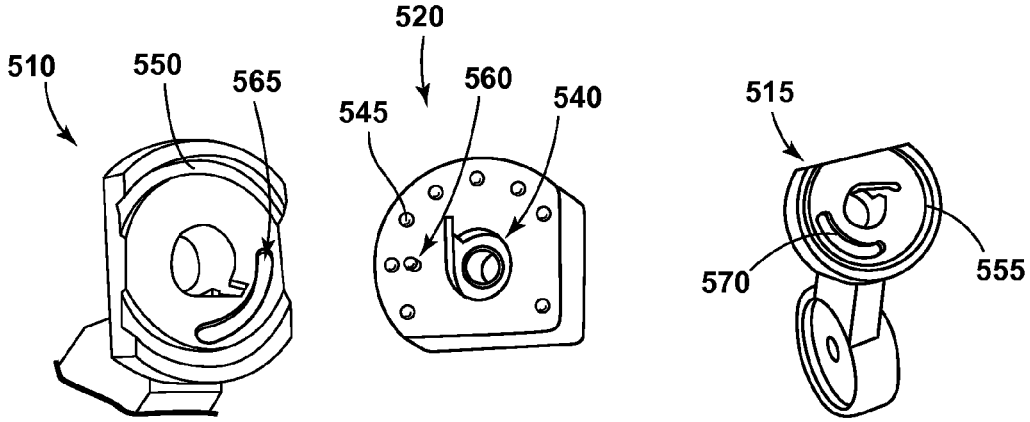
Figure 5D:
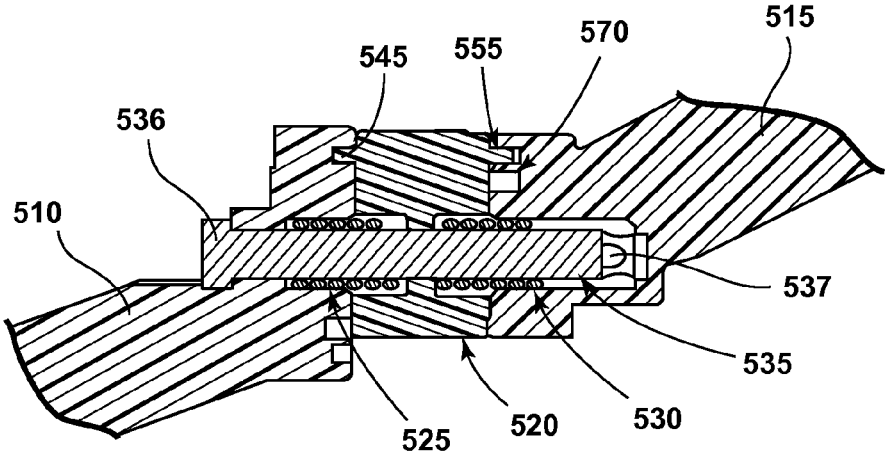

FIGS. 5A-D illustrate an example three-part icemaker bail arm 500 that may be used to implement the example bail arm 115 of FIGS. 1 and 2. FIG. 5A is a side-view of the example bail arm 500. FIG. 5B is a portion 505 of bail arm 500 in detail. FIG. 5C illustrates the parts 510, 515, and 520 shown in FIG. 5B separated and in detail. FIG. 5D is a cross-sectional view of the portion 505.

Like the example two-part bail arm 400 of FIGS. 4A and 4B, the example three-part bail arm 500 of FIGS. 5A-D rotates about a horizontal axis into a substantially flat profile. However, unlike the bail arm 400, the example bail arm 500 can rotate both forward and backward, providing additional abilities to clear the ice bin 125. For example, if the ice bin 125 were to be completely removed while the bail arm 500 is at least partially down, if the bail arm 500 becomes positioned behind the ice bin 125 while the ice bin 15 is tilted forward, etc. the bail arm 500 can also rotate backward allowing the bail arm 500 to clear the ice bin 125 as it is returned to the stored position.

To enable this additional rotational direction, the example three-part bail arm 500 includes a third or middle member 520 between the lower member 510 and the upper member 515. As shown in FIG. 5A, the upper member 515 has a hole 516 that allows the bail arm 500 to rotate up and down within the ice bin 125. The upper, middle and lower members 510, 520, 515 meet at vertical angles, in the orientation of FIGS. 5A-D.

To bias the lower member 510 into longitudinal alignment with the upper member 515 when, for example, no or only a smaller lateral force is acting on the lower member 510, the example bail arm 500 includes a left-handed torsion spring 525 and a right-handed torsion spring 530 arranged horizontally, in the orientation of FIGS. 5A-D. The left-handed torsion spring 525 biases the lower member 510 backward into longitudinal alignment with the upper member 515. The right-handed torsion spring 530 biases the lower member 510 forward into longitudinal alignment with the upper member 515

To hold the members 510, 520, 515 together, the bail arm 500 includes a hinge pin, fastener, screw, bolt, etc. 535 that passes at least partially through the members 510, 520, 515. Of course, other arrangements may be used. The pin 535 passes through and is coaxial with the torsion springs 525, 530. As shown in FIG. 5D, the example pin 535 has a head 536 that engages the lower member 510, and a snap fitting 537 that engages the upper member 515. The lower and upper members 510, 515 are rotatable about the pin 535.

In response to a forward lateral force, the lower member 510 rotates forward relative to the members 520, 515, bringing the lower member 510 from a downward position forward toward a horizontal position. In response to a backward lateral force, the lower member 510 rotates relative to the members 510, 520, bringing the lower member 510 from a downward position backward toward a horizontal position. That is the lower member 510 rotates about a longitudinal axis of the pin 535.

To engage the springs 525, 530, the example members 510, 520, 515 have respective spring guides, one of which is designated at reference numeral 540. The spring guides 540 engage respective ends of the springs 525, 530 so the springs 525, 530 become loaded as the lower member 510 rotates in a respective direction. For example, as the lower member 510 rotates forward, the spring 525 becomes loaded and able to provide a backward biasing force to the lower member 510.

To align the members 510, 520 and 515, the middle member 520 has an arc of protrusions (one of which is designated at reference numeral 545) on each side of the middle member 520 that mate with corresponding grooves 550, 555 of the lower and upper members 510, 515.

To define a rotational range of motion, the middle member 520 has a protrusion (one of which is designated at reference numeral 560) on each side of the middle member 520 that mates with corresponding grooves 565, 570 of the lower and upper members 510, 515. The grooves 565, 570 prevent both of the springs 525, 530 from becoming loaded at the same time. For example, as the lower member 510 rotates forward, the middle member 520 is prevented from rotating by the slot 570, thus, preventing the spring 530 from becoming loaded.

Figure 6:
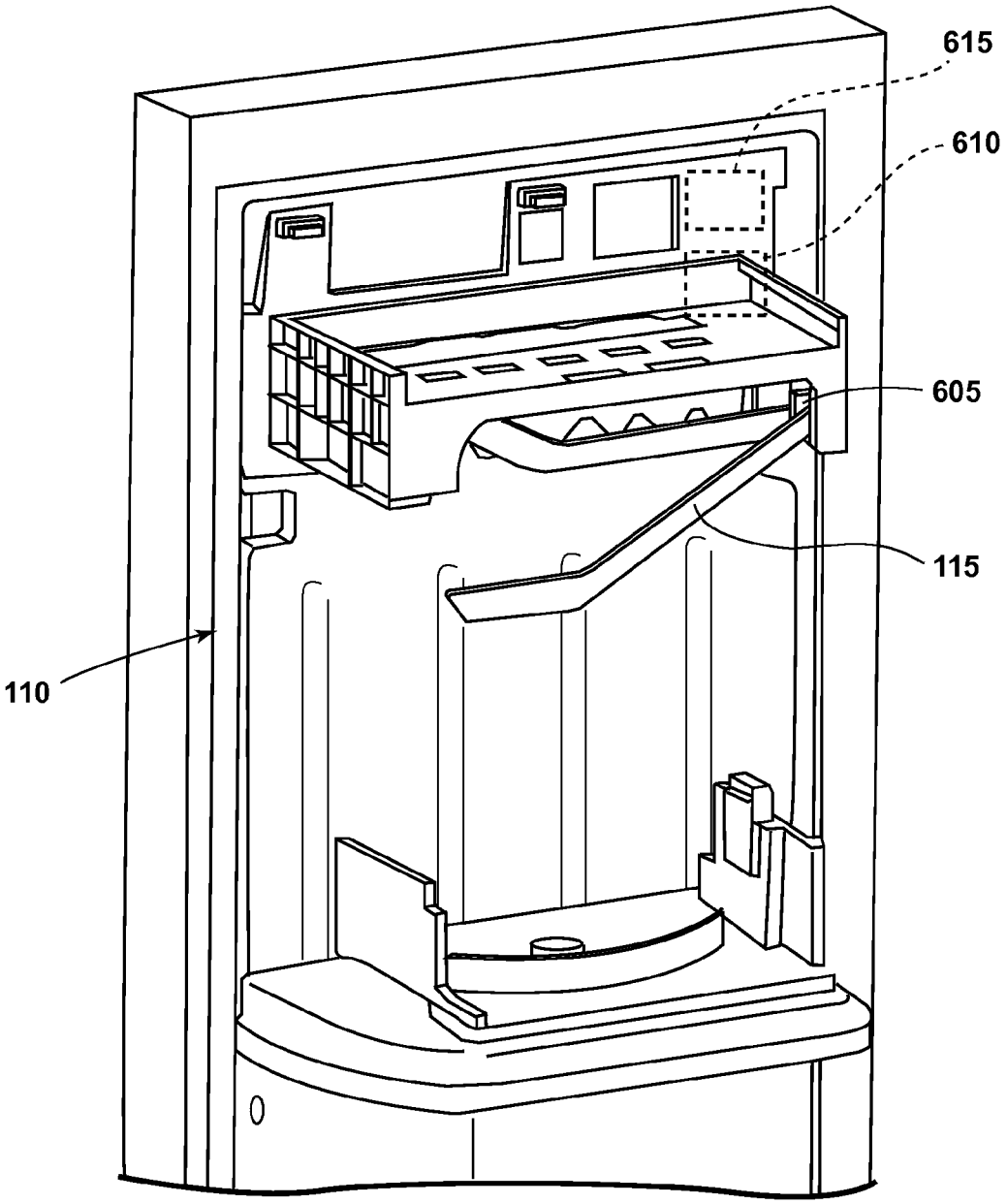
FIG. 6 illustrates an example icemaker having a battery-powered bail arm retractor.

Turning to FIG. 6, to prevent or reduce inadvertent bail arm damage, breakage, or jamming during a power outage or when the refrigerator 100 is not powered, the example icemaker 110 of FIG. 6 includes a direct current (DC) motor 605, a battery 610, and an AC power source monitor 615. When the AC power source monitor 615 detects an interruption in AC power, the DC motor 605 automatically retracts the bail arm 115 to its up or retracted position. The DC motor 605 operates using power provided by the battery 610. In some examples, the DC motor 605 is automatically connected to the battery 610 by a relay that returns to its normal closed position when an AC power outage occurs, thereby obviating the need to provide power for a more complicated circuit or controller to control operation of the DC motor 605. In such examples, the AC power source monitor 615 simply provides a digital control signal or power supply voltage of a control circuit or controller within the refrigerator 100 that is used to hold the relay open as long as AC power is active. The DC motor 605 stops, for example, when the bail arm 115 reaches its up or retracted position, which trips a mechanical cut-off switch that disconnects the battery 610 from the motor 605.

Although certain examples have been described herein, the scope of coverage of this patent is not limited thereto. On the contrary, this patent covers all methods, apparatus and articles of manufacture fairly falling within the scope of the claims of this patent.

What is claimed is:

1. A multi-part icemaker bail arm, comprising:

a first member having a first arm portion, a first end rotationally attached to an icemaker with a first axis of rotation, and an opposite end having a first protrusion with a first hole;

a second member attached to the opposite end of the first member, the second member having a second arm portion and a second protrusion with a second hole; and a hinge pin joining the first protrusion and the second protrusion by passing through the first hole and the second hole when the holes in the first protrusion and the second protrusion are aligned;

wherein the second member is rotationally moveable about the longitudinal axis of the hinge pin rotating the second arm portion out of alignment of the first arm portion in response a lateral force applied to the second member by an ice storage bin when the ice storage bin is rotated out of a bin storage location;

a torsion spring to bias the second arm portion into alignment with the first arm portion by rotationally moving the second arm portion about the longitudinal axis of the hinge pin when the lateral force is removed; and wherein the first axis of rotation and the longitudinal axis of the hinge pin are non-parallel.

2. A multi-part icemaker bail arm as defined in claim 1, wherein the hinge pin passes through and is coaxial with the torsion spring.

3. A multi-part icemaker bail arm as defined in claim 1, wherein the hinge pin extends perpendicularly at least partially across the second member.

4. A multi-part icemaker bail arm as defined in claim 1, wherein the multi-part icemaker bail arm is rotatable up and down within the ice storage bin about the first end.

5. A multi-part icemaker bail arm as defined in claim 1, wherein the hinge pin connecting the first and second members passes through and is coaxial with the torsion spring.

6. A multi-part icemaker bail arm as defined in claim 1, wherein one of the first protrusion and the second protrusion forms a portion of a slot in the respective one of the first member and second member, and the other protrusion fits within the slot.

7. A multi-part icemaker bail arm as defined in claim 1, wherein the first protrusion is a portion of the first arm portion and the second protrusion is a portion of the second arm portion.

8. A multi-part icemaker bail arm as defined in claim 1, wherein the bin storage location is part of a door for a refrigerating appliance.

* * * * *